US008714698B2

(12) United States Patent
Suzuki

(10) Patent No.: US 8,714,698 B2
(45) **Date of Patent: *May 6, 2014**

(54) IMAGE FORMING APPARATUS

(71) Applicant: Kazuki Suzuki, Kanagawa (JP)

(72) Inventor: Kazuki Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/718,045

(22) Filed: Dec. 18, 2012

(65) Prior Publication Data

US 2013/0176361 A1 Jul. 11, 2013

(30) Foreign Application Priority Data

Jan. 5, 2012 (JP) ..... 2012-000373

(51) Int. Cl.
*B41J 2/165* (2006.01)

(52) U.S. Cl.
USPC ..... 347/30; 347/29; 347/32

(58) Field of Classification Search
USPC ..... 347/29, 30, 32
See application file for complete search history.

(56) References Cited

U.S. PATENT DOCUMENTS

| | | | | |
|---|---|---|---|---|
| 7,866,790 | B2 * | 1/2011 | Miyazawa | 347/33 |
| 2007/0052750 | A1 * | 3/2007 | Tokuno et al. | 347/30 |
| 2009/0015632 | A1 | 1/2009 | Suzuki et al. | |
| 2009/0122122 | A1 | 5/2009 | Kubo et al. | |
| 2010/0321426 | A1 | 12/2010 | Suzuki et al. | |
| 2012/0056932 | A1 | 3/2012 | Matsubara et al. | |

FOREIGN PATENT DOCUMENTS

| | | |
|---|---|---|
| JP | 2005-144912 | 6/2005 |
| JP | 2007-223227 | 9/2007 |

OTHER PUBLICATIONS

U.S. Appl. No. 13/558,817, filed Jul. 26, 2012, Kazuki Suzuki.

* cited by examiner

*Primary Examiner* — Matthew Luu
*Assistant Examiner* — Alexander D Shenderov
(74) *Attorney, Agent, or Firm* — Cooper & Dunham LLP

(57) ABSTRACT

An image forming apparatus includes recording heads, a maintenance device, a carriage, cap members, cams, a cam shaft, a feeler member, a home position detection device, and a cap position determination device. The feeler member has a first portion to detect a home position of the cam shaft with the home position detection device and a second portion to determine with the cap position determination device whether the cap members are at a raised position or a lowered position. When the cap position determination device determines that a suction cap is at the raised position, the suction cap is lowered to the lowered position before the carriage mounting the recording heads moves for scanning in a first direction. When the cap position determination device determines that the suction cap is at the lowered position, the carriage is permitted to move to a print start position.

4 Claims, 14 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application No. 2012-000373, filed on Jan. 5, 2012, in the Japan Patent Office, the entire disclosure of which is hereby incorporated by reference herein.

BACKGROUND

1. Technical Field

This disclosure relates to an image forming apparatus, and more specifically to an image forming apparatus including a moving assembly of a recording head having droplet ejection nozzles and a maintenance device.

2. Description of the Related Art

Image forming apparatuses are used as printers, facsimile machines, copiers, plotters, or multi-functional devices having two or more of the foregoing capabilities. Such image forming apparatuses may use a droplet ejection device having a recording head (droplet ejection head) to eject droplets of ink or other liquid.

Such a droplet-ejection type of image forming apparatus typically, while conveying a recording medium (e.g., a recording sheet of paper), ejects liquid droplets from a recording head and attaches or penetrates the droplets on the recording medium for image formation. The recording medium (target) is not limited to the above-described recording sheet of paper but is made of string, fiber, leather, metal, resin, glass, timber, ceramic, or any other material on which liquid is attachable or penetrable.

The droplet ejection device performs maintenance and recovery operation (hereinafter, maintenance operation) to prevent faulty ejection of liquid from nozzles of the recording head. The maintenance operation is a process of preventing an increase in the viscosity of ink or other liquid due to natural drying and removing viscosity-increased and firmly adhered liquid by sucking operation to maintain and recover performance of the recording head, and a maintenance and recovery device (hereinafter, maintenance device) is used to perform the maintenance operation.

The maintenance device includes a cap member to seal a nozzle face of the recording head to maintain a humid state, a wiper member to wipe the nozzle face, and a suction pump connected to the cap member. The maintenance device performs cleaning operation to create a negative pressure by the suction pump with the nozzle face sealed with the cap member to forcefully discharge bubbles or viscosity-increased liquid from nozzles of the recording head.

During not only the maintenance operation but also a standby period of the recording head, the cap member seals the nozzle face of the recording head to maintain a humid state of the nozzles, thus minimizing drying of liquid and an increase in the viscosity of liquid.

As a configuration of the maintenance device, for example, JP-2007-223227-A proposes to provide cap and other members detachably attachable relative to nozzle faces of recording heads. For example, in a case in which liquid droplets are ejected from the recording heads in a vertical direction, the cap members are elevated up and down relative to the nozzle faces of the recording heads facing down. For such a configuration, an elevation start position of a cam of an elevation driving unit is set by determining a rotation start position, i.e., a home position of a cam shaft so that a rising stroke for appropriate contact between a nozzle face of a recording head and the cap and other members can be obtained when the cam is raised from the elevation start position.

In addition, as a configuration of defining an opposing position at which, when raised, a cap member opposes a nozzle face of a recording head, for example, JP-4233984-B (JP-2005-144912-A) proposes to engage an engagement claw of a cap member with an engagement portion of a nozzle face of a recording head to define the opposing position.

If cap and other members oppose a nozzle face of a recording head at a position differing from a predetermined opposing position and are raised in response to a rotation of a cam shaft to detect a home position of the cam shaft, a portion of the cap and other members might contact the nozzle face of the recording head. In particular, if a carriage mounting the recording head is moved when the cap and other members are not placed at a predetermined position, for example, an engagement claw of the cap member might contact the nozzle face of the recording head, thus damaging nozzles or menisci of nozzles.

BRIEF SUMMARY

In an aspect of this disclosure, there is provided an image forming apparatus including a plurality of recording heads, a maintenance device, a carriage, a plurality of cap members, a plurality of cams, a cam shaft, a feeler member, a home position detection device, and a cap position determination device. The plurality of recording heads has a plurality of nozzle rows to eject liquid droplets and a plurality of nozzle faces provided with the plurality of nozzle rows. The maintenance device maintains and recovers an ejection performance of the plurality of recording heads. The carriage mounts the plurality of recording heads and is movable for scanning in a first direction. At least one of the plurality of nozzle rows of the plurality of recording heads is offset from at least another of the plurality of nozzle rows in a second direction perpendicular to the first direction. The plurality of cap members caps the plurality of nozzle faces. At least one of the plurality of cap members is a suction cap reciprocally movable in the second direction to cap each of the plurality of nozzle faces to suck liquid from the plurality of nozzle rows. The plurality of cams raises and lowers the plurality of cap members. The cam shaft is mounted with the plurality of cams to rotate the plurality of cams. The feeler member of a semicircular shape is mounted on the cam shaft to rotate with the cam shaft. The home position detection device detects the feeler member to detect a home position of the cam shaft. The cap position determination device determines whether the plurality of cap members is at a raised position or a lowered position. The feeler member has a first portion to detect the home position of the cam shaft with the home position detection device and a second portion to determine with the cap position determination device whether the plurality of cap members is at the raised position or the lowered position. When the cap position determination device determines that the suction cap is at the raised position, the suction cap is lowered to the lowered position before the carriage mounting the plurality of recording heads moves for scanning in the first direction. When the cap position determination device determines that the suction cap is at the lowered position, the carriage is permitted to move to a print start position.

BRIEF DESCRIPTION OF THE DRAWINGS

The aforementioned and other aspects, features, and advantages of the present disclosure would be better understood by reference to the following detailed description when considered in connection with the accompanying drawings, wherein.

DETAILED DESCRIPTION OF EXEMPLARY EMBODIMENTS

Figure 1:
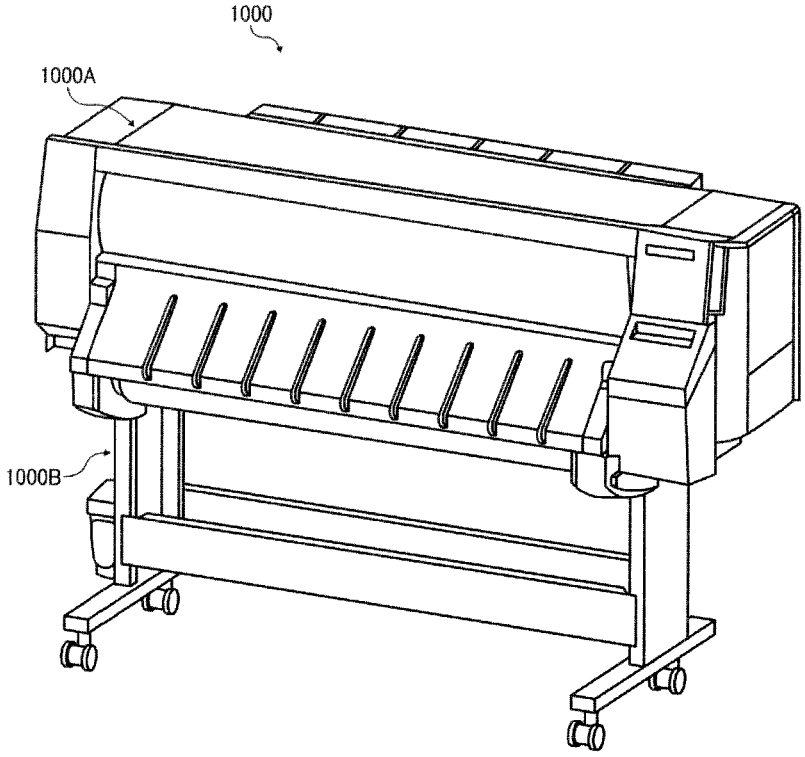
FIG. 1 is an external perspective view of an image forming apparatus according to an exemplary embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached.

The term "ink" is not limited to "ink" in a narrow sense, unless specified, but is used as a generic term for any types of liquid useable as targets of image formation. For example, the term "ink" includes recording liquid, fixing solution, DNA sample, resist, pattern material, resin, and so on.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

FIG. 1 is a perspective view of an image forming apparatus 1000 according to an exemplary embodiment of this disclosure.

The image forming apparatus 1000 illustrated in FIG. 1 is a serial-type inkjet recording apparatus to eject droplets of ink or other liquid to a recording target, e.g., a recording sheet of a large size, such as A1 size, to form an image on the recording target. It is to be noted that the image forming apparatus is not limited to such a serial-type inkjet recording apparatus and may be any other type image forming apparatus. In FIG. 1, the image forming apparatus 1000 has a printing unit 1000A and a support leg 1000B to mount the printing unit 1000A.

Figure 2:
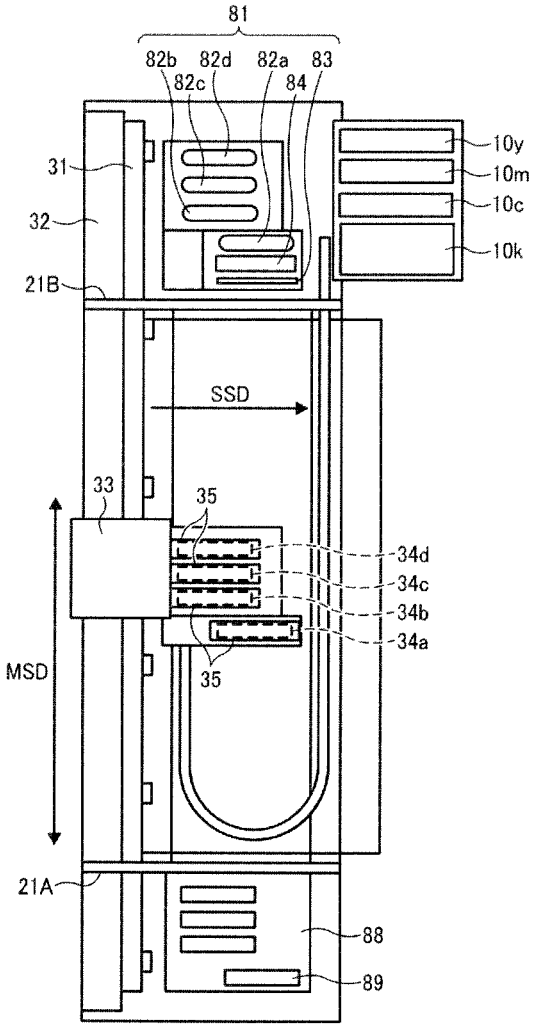
FIG. 2 is a schematic plan view of a configuration of a printing section of the image forming apparatus of FIG. 1.

FIG. 2 is a schematic view of the printing unit 1000A in this exemplary embodiment.

In the printing unit 1000A illustrated in FIG. 2, a main guide rod 31 and a sub sheet metal guide 32 serving as guide members hold a carriage 33 so as to be slidable in a direction (main scanning direction) indicated by an arrow MSD in FIG. 2. The main guide rod 31 and the sub sheet metal guide 32 extend between a left-side plate 21A and a right-side plate 21B of an apparatus body. The carriage 33 is reciprocally moved for scanning in the main scanning direction by a main scanning motor and a timing belt.

Figure 3A:
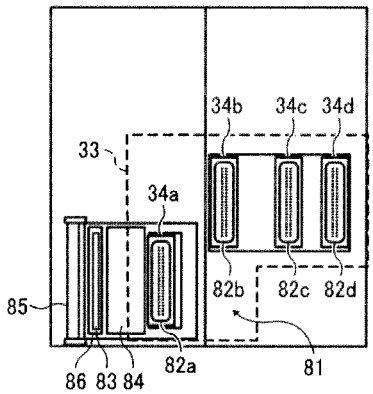
FIGS. 3A to 3C are schematic views of recording heads and a maintenance device used in the image forming apparatus of FIG. 2.
Figure 3B:
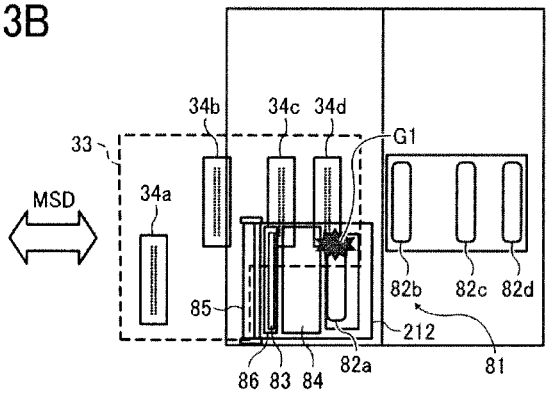
Figure 3C:
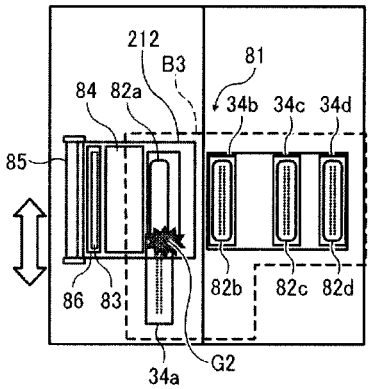

The carriage 33 mounts recording heads 34*a*, 34*b*, 34*c*, and 34*d* (hereinafter, collectively referred to as "recording heads 34" unless distinguished) in which nozzle rows are arranged as illustrated in FIGS. 3A to 3C. For the arrangement of nozzle rows illustrated in FIGS. 3A to 3C, unlike a configuration in which multiple nozzle rows are arranged side by side in the main scanning direction MSD, one pair of nozzle rows is arranged independent of the other pairs of nozzle rows. Head tanks 35 illustrated in FIG. 2 supply ink to the nozzle rows of the recording heads 34.

In such a case, at least one recording head (e.g., the recording heads 34*a* and 34*b* in FIG. 2) is set as a recording head for ejecting droplets of frequently used ink, e.g., black ink. In addition, the number of nozzles forming nozzle rows of the recording head(s) for frequently used ink is set to be greater than the number of nozzles forming nozzle rows of the other recording heads, and the recording head(s) for frequently used ink (e.g., the recording head 34*a* in FIG. 2) is (are) arranged at a position offset from the other recording heads to enhance the productivity of image formation.

For the arrangement of nozzle rows illustrated in FIG. 3, the nozzle rows of the recording head 34*a* serving as a recording head for frequently used ink are offset from the nozzle rows of the other recording heads 34*b*, 34*c*, and 34*d* in a sub scanning direction or sheet conveyance direction (indicated by an arrow SSD in FIG. 2), i.e., a direction perpendicular to a scanning movement direction (main scanning direction) of the carriage 33 indicated by the arrow MSD in FIGS. 2 and 3B. In FIGS. 3A to 3C, the carriage 33 on which the recording heads 34 are arranged is indicated by broken lines. For the arrangement of nozzle rows illustrated in FIG. 3, each recording head 34 has two nozzle rows. The nozzle rows of the recording heads 34*a* and 34*b* eject droplets of black ink, and the nozzle rows of the recording heads 34*c* and 34*d* eject droplets of other color inks, e.g., cyan, yellow, and magenta.

It is to be noted that the nozzle rows may be allocated to the respective recording heads 34 in a different manner. For example, the nozzle rows may be arranged in the recording heads 34 according to a color arrangement differing from the above-described color arrangement. In a case in which, as illustrated in FIG. 3, each recording head 34 has two nozzle rows, as described above, the two adjacent nozzle rows of each recording head 34 may be used for the same color. Alternatively, one of the two adjacent nozzle rows of each recording head 34 may be used for different colors or a single color and the other of the two adjacent nozzle rows may be a dummy nozzle row, i.e., a non-ejection nozzle row.

As illustrated in FIG. 2, a maintenance device 81 is disposed in a non-printing (non-recording) area at one end (right side in FIG. 2) in the main scanning direction MSD of the carriage 33. The maintenance device 81 maintains and recovers nozzle conditions of the recording heads 34.

Figure 4:
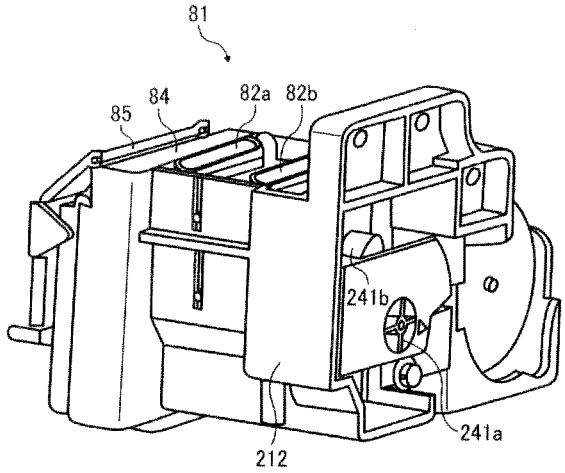
FIG. 4 is an external perspective view of a maintenance device according to an exemplary embodiment of this disclosure.
Figure 5:
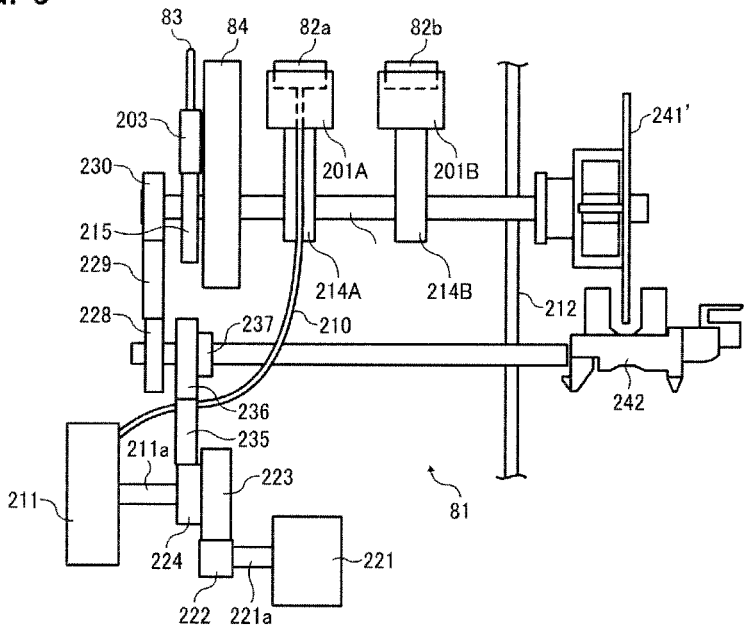
FIG. 5 is a schematic view of a driving unit of cap members used in the maintenance device of FIG. 4.
Figure 6:
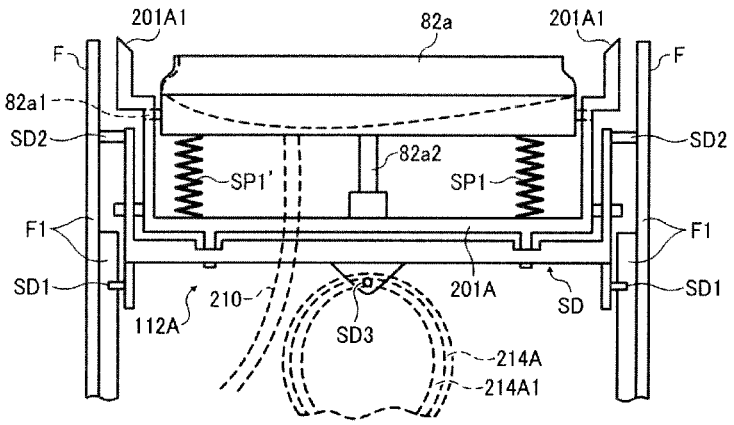
FIG. 6 is a schematic view of a positioning assembly of the maintenance device illustrated in FIG. 5.

FIGS. 4 to 6 are schematic views of a configuration of the maintenance device 81 according to an exemplary embodiment of this disclosure.

The maintenance device 81 has cap members to retain moisture of nozzles, and at least one of the cap members sucks ink from nozzle rows. For example, in FIGS. 4 and 5, the maintenance device 81 has cap members 82*a* and 82*b* (referred to as "cap members 82" unless distinguished) to cap nozzle faces of the recording heads 34 on which nozzles are formed. The cap member 82*a* (may be referred to as "suction cap member 82*a*") retains moisture of nozzle rows and sucks ink from nozzle rows. The cap member 82*b* (may be referred to as "moisture-retention cap member 82*b*") retains moisture of nozzle rows.

The maintenance device 81 also has a cap holder 201A, a cap holder 201B, a wiper blade 83, a blade holder 203, a dummy ejection receptacle 84, and a wiper cleaner 85. The cap holder 201A includes a holding mechanism to hold the suction cap member 82*a*, and the cap holder 201B includes a holding mechanism to hold the moisture-retention cap member 82*b*. The wiper blade 83 is a blade member formed of an elastic body to clean (wipe) the nozzle faces of the recording heads 34 and is held by the blade holder 203. The dummy ejection receptacle 84 receives droplets ejected by dummy ejection (preliminary ejection) in which droplets not contributing to printing are ejected. The wiper cleaner 85 illustrated in FIG. 4 cleans the wiper blade 83.

As illustrated in FIG. 5, the suction cap member 82*a* is connected to a tubing pump (suction pump) 211 serving as a suction device via a flexible tube 210. When maintenance operation is performed on one of the recording heads 34, the recording head 34 is selectively moved to a capping position at which the recording head 34 is capped with the suction cap member 82*a*. In addition, a cam shaft 213 is disposed below the cap holders 201A and 201B and rotatably supported by a frame 212. Cap cams 214A and 214B, a wiper cam 215, a cleaner cam are mounted on the cam shaft 213. The cap cams 214A and 214B raise and lower the cap holders 201A and 201B, respectively. The wiper cam 215 raises and lowers the blade holder 203. The cleaner cam swings the wiper cleaner 85.

In FIG. 5, to rotate the tubing pump 211 and the cam shaft 213, a motor gear 222 on a motor shaft 221*a* of a motor 221 engages a pump gear 223 on a pump shaft 211*a* of the tubing pump 211. An intermediate gear 224 integrally formed with the pump gear 223 engages an intermediate gear 235, and the intermediate gear 235 engages an intermediate gear 236 having a one-way clutch 237. An intermediate gear 228 coaxial to the intermediate gear 236 engages an intermediate gear 229, and the intermediate gear 229 engages a cam gear 230 fixed on the cam shaft 213.

For the maintenance device 81, when the motor 221 rotates in a forward direction (forward rotation), the motor gear 222, the pump gear 223, the intermediate gear 224, and the intermediate gears 235 and 236 rotate. Then, the pump shaft 211*a* of the tubing pump 211 rotates to activate the tubing pump 211, thus sucking the inside of the suction cap member 82*a* (this operation is referred to as "cap inside suction" or "head suction"). Since the rotation is blocked by the one-way clutch 237, the intermediate gear 228 or subsequent transmission members are not rotated (activated).

When the motor 221 rotates in a reverse direction (reverse rotation), the one-way clutch 237 is jointed and the rotation of the motor 221 is transmitted to the cam gear 230 via the motor gear 222, the pump gear 223, the intermediate gear 224, the intermediate gears 235, 236, 228, 229, thus rotating the cam shaft 213. At this time, the tubing pump 211 is not activated by reverse rotation of the pump shaft 211*a*.

Rotation of the cam shaft 213 raises and lowers the cap cams 214A and 214B and the wiper cam 215 at certain timings.

For example, when cleaning is performed on the recording heads 34*a*, 34*b*, 34*c*, and 34*d* (See FIG. 2), the recording heads 34*a*, 34*b*, 34*c*, and 34*d* are moved relative to the wiper blade 83 with the wiper blade 83 being in a raised state. Thus, the nozzle faces of the recording heads 34*a*, 34*b*, 34*c*, and 34*d* are wiped by the wiper blade 83.

Figure 7A:
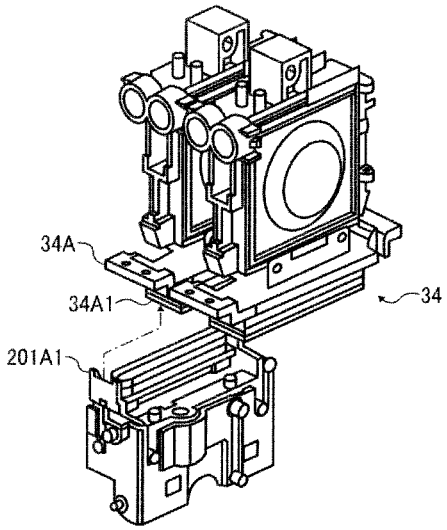
FIGS. 7A and 7B are schematic views of a carriage and the maintenance device illustrated in FIG. 6.
Figure 7B:
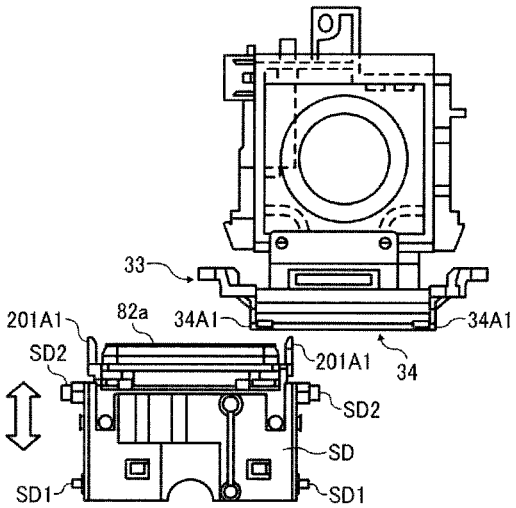

When the cap holders 201A and 201B are raised, the suction cap member 82*a* and the wiper blade 83 oppose the nozzle faces of the recording heads 34 at predetermined positions. The predetermined positions are defined by a positioning assembly illustrated in FIGS. 6, 7A, and 7B. FIG. 6 is a schematic view of the suction cap member 82*a* and its surrounding part. As illustrated in FIGS. 6, 7A, and 7B, for the positioning assembly in this exemplary embodiment, a part of the cap holder 201A elevatably holding the suction cap member 82*a* removably engages a part of the carriage 33 illustrated in FIGS. 7A and 7B.

Ahead of a description of the positioning assembly, an elevating assembly of the cap holder 201A is described with reference to FIG. 6.

At the part of the cap holder 201A forming a portion of the positioning assembly, a cap holder assembly 112A serving as a cap holding assembly is provided with the cap holder 201A, springs SP1 and SP1', and a slider SD. The cap holder 201A holds the suction cap member 82*a* so that the suction cap member 82*a* can elevate up and down. The springs SP1 and SP1' are disposed between a bottom face of the cap holder 201A and a bottom portion of the suction cap member 82*a* to urge the suction cap member 82*a* upward. The slider SD holds the cap holder 201A so that the cap holder 201A is movable along a direction in which the cap holder 201A is elevated up or down.

The suction cap member 82*a* has guide pins 82*a*1 at its opposed ends, and the guide pins 82*a*1 are inserted to guide grooves of the cap holder 201A so as to be movable upward and downward along the guide grooves. The suction cap member 82*a* also has a guide shaft 82*a*2 at its bottom face, and the guide shaft 82*a*2 is inserted through the cap holder 201A so as to be movable upward and downward. Thus, the suction cap member 82*a* is mounted so as to be able to move upward and downward relative to the cap holder 201A. The spring SP1 disposed between the suction cap member 82*a* and the cap holder 201A urges the suction cap member 82*a* upward, i.e., in a direction to push a nozzle face of a recording head in capping operation.

The slider SD has guide pins SD1 and SD2 at front and rear ends. The guide pins SD1 and SD2 slidably engage guide grooves F1 of a frame F. Thus, the slider SD, the cap holder 201A, and the suction cap member 82*a* can entirely move upward and downward in FIG. 6.

The slider SD has a cam pin SD3 at a lower face, and the cam pin SD3 engages a cam groove 214A1 of a cap cam 214A. When the rotation of the motor 221 is transmitted to the cam shaft 213 as described above, the cap cam 214A rotates with rotation of the cam shaft 213, thus causing the slider SD, the cap holder 201A, and the suction cap member 82*a* to move upward and downward in FIG. 6

For such a configuration, engagement hooks 201A1 are used as members of the positioning assembly defining the positions at which the suction cap member 82*a* opposes a nozzle face of a recording head 34. In FIG. 6, the engagement hooks 201A1 are disposed at portions extending upward at lateral sides of the suction cap member 82*a*.

As illustrated in FIGS. 7A and 7B, when the above-described members are raised, the engagement hooks 201A1 can engage engagement portions 34A1 of a frame 34A of a recording head 34. The engagement portions 34A1 serve as members of a counterpart of the positioning assembly. When the engagement hooks 201A1 engage the engagement portions 34A1, a position at which the nozzle face of the recording head 34 opposes the suction cap member 82*a* is appropriately defined. In FIGS. 7A and 7B, a state in which the cap holder 201A is lowered in a direction away from the recording head 34 of the carriage 33 is schematically illustrated to show the engagement hooks 201A1 and the engagement portions 34A1.

In this exemplary embodiment, nozzle rows of at least one recording head 34 (e.g., the recording head 34*a* in FIGS. 2 and 3A to 3C) is disposed at a position offset from nozzle rows of the other recording heads 34 (e.g., the recording heads 34*b*, 34*c*, and 34*d* in FIGS. 2 and 3A to 3C) in the sub-scanning direction SSD. In this configuration, since only one cap member for ink suction, i.e., the suction cap member 82*a* is provided, the suction cap member 82*a* needs to perform sucking operation on not only the recording head 34*a* but also the recording heads 34*b*, 34*c*, and 34*d*. Hence, in this exemplary embodiment, the cap holder 201A with the suction cap member 82*a* is reciprocally movable along the sub scanning direction (nozzle row direction) to a sub scanning position at which the suction cap member 82*a* can perform sucking operation on the recording heads 34*b*, 34*c*, and 34*d*.

Figure 8A:
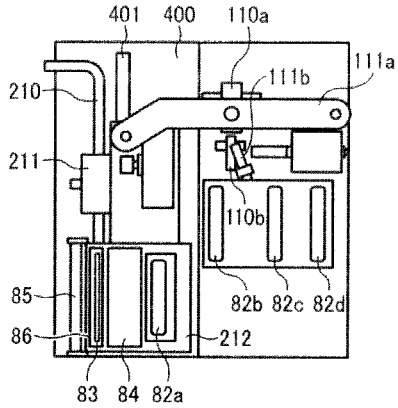
FIGS. 8A and 8B are schematic plan views of a maintenance device according to an exemplary embodiment of this disclosure.
Figure 8B:
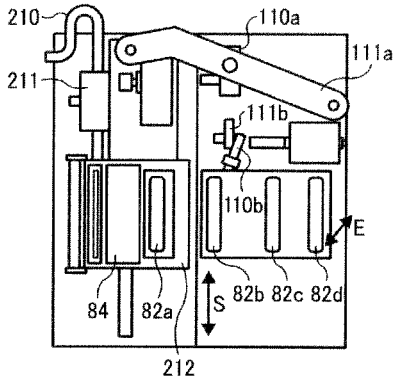
Figure 8C:
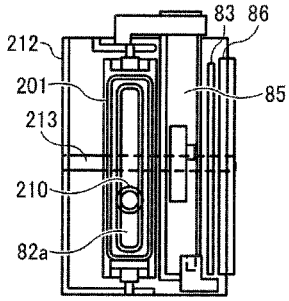
FIG. 8C is a schematic plan view of a portion of the maintenance device of FIGS. 8A and 8B.

FIGS. 8A to 8C show a configuration of a sliding assembly for reciprocally moving a portion of the maintenance device 81 in the sub-scanning direction so that the maintenance device 81 can oppose the nozzle rows of the recording heads.

As illustrated in FIGS. 8A and 8B, the frame 212 of the maintenance device 81 is mounted on a guide rail 401 on a maintenance frame 400 so as to be reciprocally movable (slidable) in the sub-scanning direction (indicated by an arrow S in FIG. 8B) along the guide rail 401 on the maintenance frame 400, thus allowing the maintenance device 81 to oppose the nozzle rows of the recording heads 34 in the above-described offset arrangement. In addition, the cap members 82*b*, 82*c*, and 82*d* dedicated for moisture retention are disposed in an area of the maintenance frame 400 distal to the printing area. Sliding operation of the cap member 82*a* on the frame 212 (indicated by the arrow S in FIG. 8B) and elevating operation of the cap members 82*b*, 82*c*, and 82*d* (indicated by an arrow E in FIG. 8B) are switched by switching the forward and reverse rotation of the motor and the driving with two one-way clutches.

For the sliding operation in the sub-scanning direction and the cap elevating operation, rotational motion is converted to linear motion by eccentric cams 110*a* and 110*b* and arms 111*a* and 111*b*. Thus, when maintenance operation is performed on the recording heads 34, the carriage 33 is moved in the main scanning direction to a position at which a target one of recording heads 34 can be capped with the suction cap member 82*a*. In addition, the frame 212 of the maintenance device 81 is moved in the sub-scanning direction to a position at which the suction cap member 82*a* can cap the target one of the recording heads 34.

Next, features of this exemplary embodiment are further described below taking the example of the inkjet recording apparatus used as the image forming apparatus having the above-described configuration.

One feature of this exemplary embodiment is that, in a feeler member serving as a portion of a cam-shaft home-position detection device to detect a home-position of the cam shaft 213 of the maintenance device 81, a cam-shaft home-position detection portion is continuously provided with a cap-position detection portion to detect a position of a cap member 82. Such a configuration allows an elevation state of the cap member 82 to be detected by a member used for detecting the home position of the cam shaft 213. In other words, such a configuration allows detection of an elevation position of the cap member 82 during one rotation of the cam shaft 213.

Figure 9A:
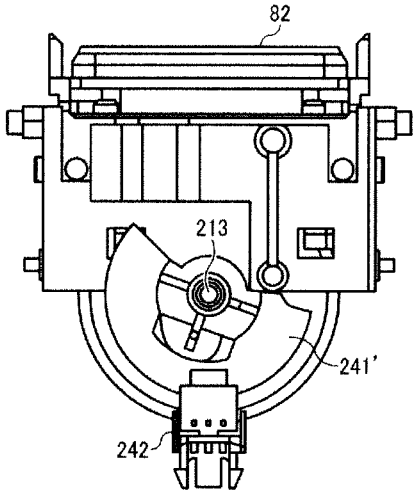
FIGS. 9A to 9C are schematic views of portion of the maintenance device illustrated in FIG. 4.
Figure 9B:
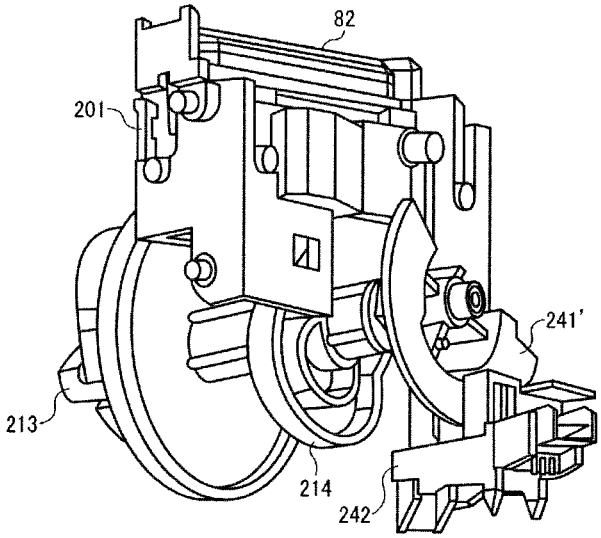
Figure 9C:
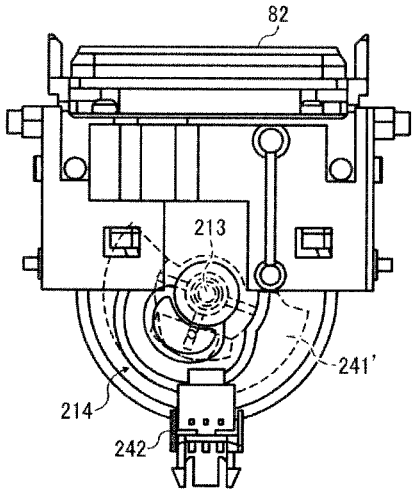

FIGS. 9A to 9C are schematic views of a cam-shaft home-position detection device serving as a portion of the maintenance device 81.

FIGS. 9A to 9C show a portion of the maintenance device 81 including the suction cap member 82*a* and the moisture-retention cap member 82*b* illustrated in FIGS. 4 and 5. (In FIGS. 9A to 9C and subsequent drawings, only one cap member 82 is illustrated for simplicity). In FIGS. 9A to 9C, the cam-shall home-position detection device of the maintenance device 81 includes a feeler member 241' having a semi-circular shape bonded to the cam shaft 213 and a cam-shaft home-position detecting sensor 242 to output detection signals in response to shading conditions of the feeler member 241'. In FIG. 9C, the feeler member 241' is indicated by a broken line to make visible the cap cam 214 disposed at a rear side of the feeler member 241'.

In this exemplary embodiment, a cap-position detecting sensor serving as a cap-position determination device to detect an elevation position of the cap member 82 is not provided as an independent sensor. The cam-shaft home-position detecting sensor 242 to detect the home position of the cam shaft 213 also serves as the cap-position detecting sensor. It is to be noted that the term "cam-shaft home-position detecting sensor 242" used herein includes both the cam-shaft home-position detecting sensor and the cap-position detecting sensor.

Figure 10:
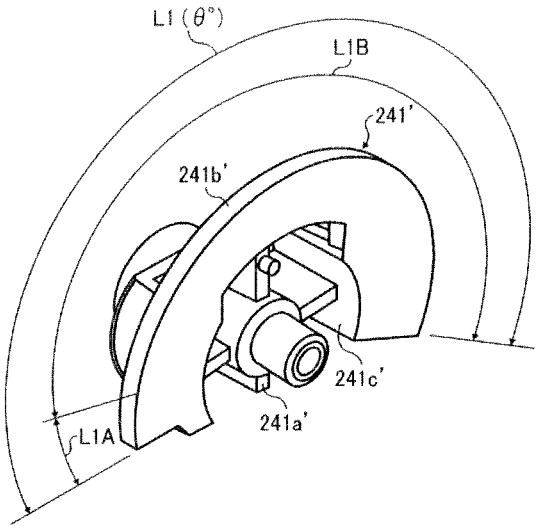
FIG. 10 is a schematic view of a feeler member used in the maintenance device illustrated in FIGS. 9A to 9C.
Figure 11:
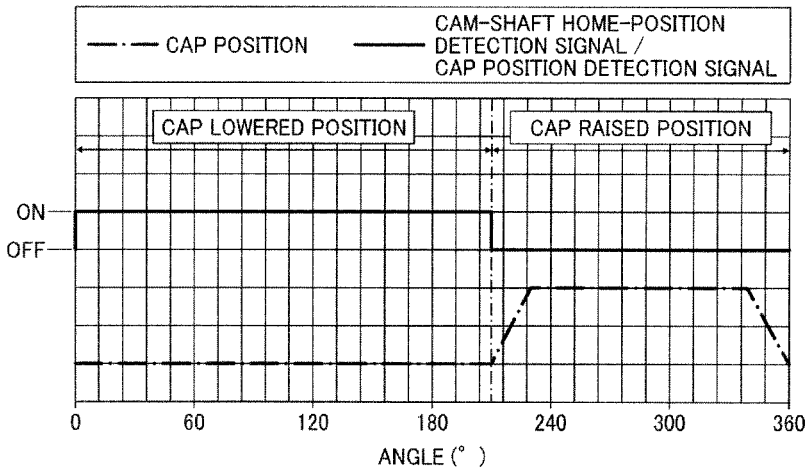
FIG. 11 is a timing chart of a relation between a cam profile and detection states by the feeler member illustrated in FIGS. 9A to 9C.

As illustrated in FIGS. 10 and 11, in the feeler member 241', a length in a circumferential direction, i.e., circumferential length of a detection edge portion 241*b'* formed of a sector portion (an area indicated by a code L1 (θ°) in FIG. 10) is continuously formed by a portion (area indicated by an arrow L1A) at which the home position of the cam shaft 213 is detectable and a portion (area indicated by an arrow L1B) at which an elevation position of the cap member 82 is determinable, i.e., a portion at which all of a period in which the cap member 82 is lowered is determinable.

For such a cam profile, in FIG. 11, the home position of the cam shaft 213 is detected by a pulse rise of 0°, and a position of the cap member 82 is detected by the portion L1B of the circumferential length set to be a length corresponding to the period in which the cap member 82 is lowered. In other words, the portion L1B of the circumferential length extended so as to correspond to the period in which the cap member 82 is lowered is used as a cap-position determining portion. Thus, the feeler member 241' and the cam-shaft home-position detecting sensor 242 used to detect the home position of the cam shaft 213 can serve as both the cam-shaft home-position detection device and the cap-position determination device.

Figure 12A:
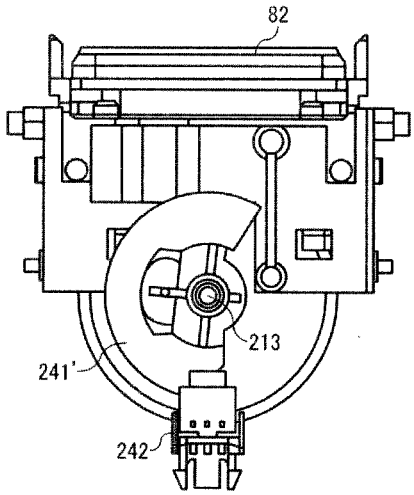
FIGS. 12A and 12B are schematic views of the maintenance device of FIGS. 9A to 9C in a state in which a cap member is lowered.
Figure 12B:
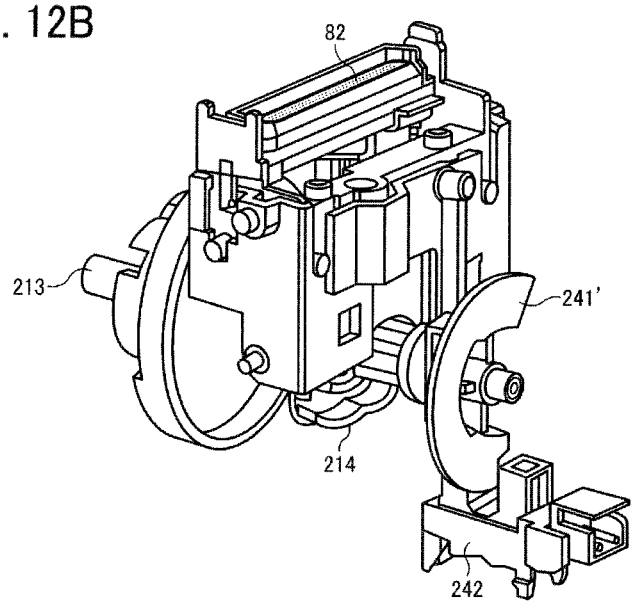

FIGS. 12A and 12B show a cap lowered position of FIG. 11. In FIGS. 12A and 12B, the feeler member 241' opposes the cam-shaft home-position detecting sensor 242 and is in a shading state. In this state, the cam-shall home-position detecting sensor 242 detects that the cap member 82 is lowered as illustrated in FIGS. 12A and 12B.

Figure 13A:
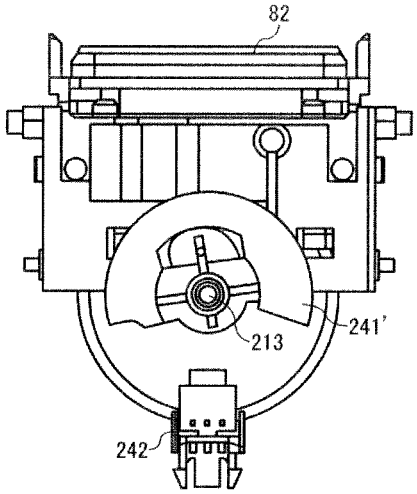
FIGS. 13A and 13B are schematic views of the maintenance device of FIGS. 9A to 9C in a state in which the cap member is raised.
Figure 13B:
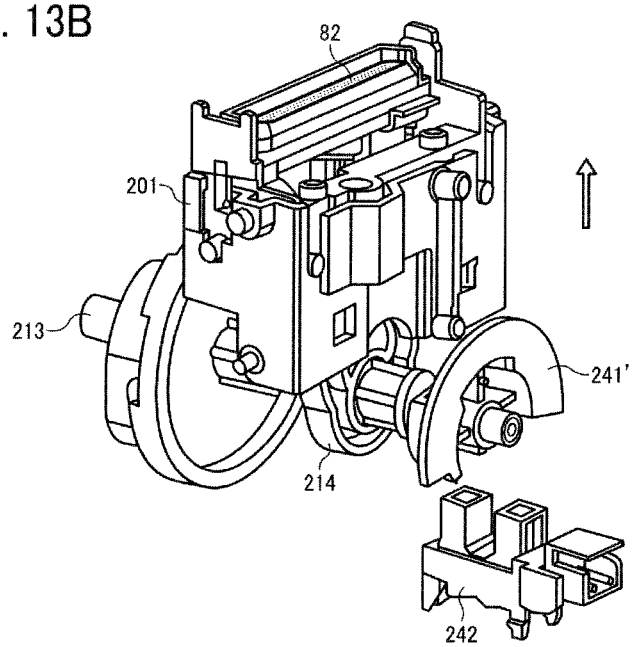

FIGS. 13A and 13B show a cap raised position of FIG. 11. In FIGS. 13A and 13B, the feeler member 241' is placed away from the cam-shaft home-position detecting sensor 242 and is in a non shading state. In this state, the cam-shaft home-position detecting sensor 242 detects that the cap member 82 is raised as illustrated in FIGS. 13A and 13B.

In this exemplary embodiment, movement of the recording head 34, i.e., the carriage 33 and elevating operation of the maintenance device 81 are set in response to detection signals from the cam-shaft home-position detecting sensor 242.

Figure 14:
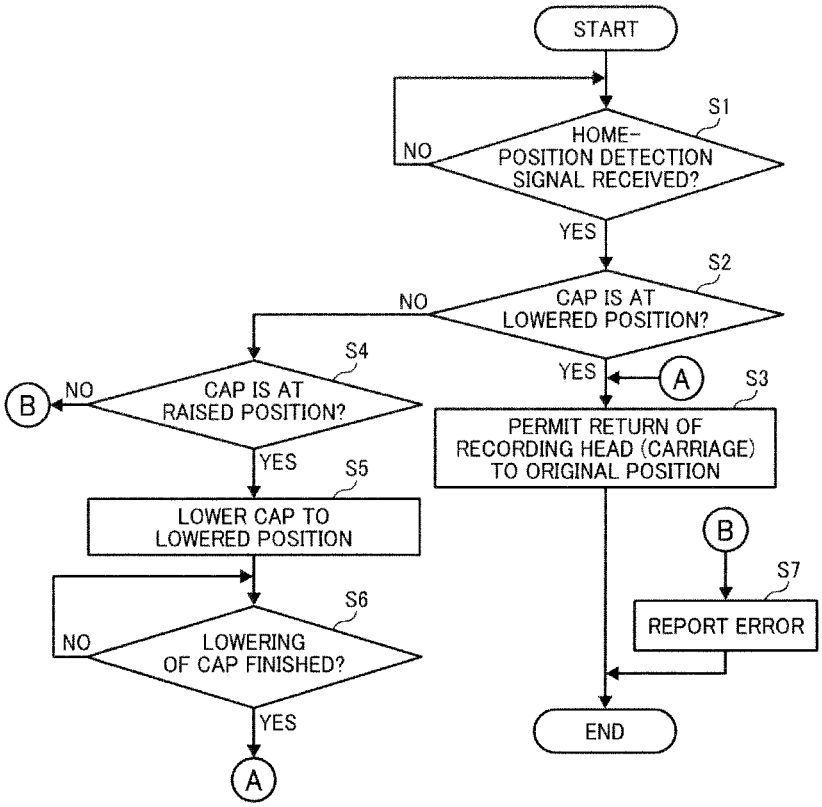
FIG. 14 is a flowchart of a procedure of control of moving a carriage and the maintenance device illustrated in FIG. 4.

FIG. 14 is a flowchart of a procedure of control of moving the carriage 33 and the maintenance device 81 in this exemplary embodiment.

The procedure of FIG. 14 is performed in, for example, a case in which, when a sheet jam occurs, a recording head 34 is stopped, and then after the sheet jam is resolved, the recording head 34 moves in a direction to return to an original position (print start position).

In FIG. 14, at S1, a controller determines whether or not the controller receives an output signal from the cam-shaft home-position detecting sensor 242. When the controller receives an output signal from the cam-shaft home-position detecting sensor 242 (YES at S1), at S2 the controller determines whether or not the output signal from the cam-shaft home-position detecting sensor 242 is a signal indicating a cap lowered position, in other words, the output signal is in ON state. When the feeler member 241' is at a lowered position corresponding to a shading state in which the feeler member 241' opposes the cam-shaft home-position detecting sensor 242 (YES at S2), at S3 the controller determines that the cap member 82 is lowered, and permits the carriage 33 to move to return to an original position (print start position).

By contrast, when the controller determines that the cap member 82 is at a raised position (No at S2 and YES at S4), at 55 the maintenance device 81 is lowered to lower the cap member 82 from the raised position to the lowered position before the recording head 34 is moved for scanning by the carriage 33. When the cap member 82 is lowered by the lowering operation of the maintenance device 81, the cap member 82 is placed at the lowered position at which the cap member 82 does not conflict the nozzle faces of the recording heads 34 on the carriage 33.

At S6, the controller determines whether or not the lowering of the cap member 82 is finished based on a change in output signal caused in response to an opposing state of the feeler member 241' and the cam-shaft home-position detecting sensor 242. When the controller determines that the lowering of the cap member 82 is finished (YES at S6), the process goes to S3 and at S3 the controller permits the carriage 33 to move for scanning to the original position. When the position of the cap member 82 is not determined at S2 and S4, at S7 the controller outputs an error signal to alert a user of an error.

This procedure presupposes that a sensor is provided to detect an original position (sliding original position) of the frame 212 of the maintenance device 81 in a sliding direction at which, e.g., the cap member 82*a* opposes the recording head 34*a* in FIGS. 3A to 3C and the controller determines whether or not the maintenance device 81 is at the sliding original position based on signals from the sensor.

Such a configuration can prevent conflict of the cap member 82*a* with the recording heads 34*b*, 34*c*, and 34*d* (indicated by a star-like solid mark G1 in FIG. 3B) caused when the cap member 82*a* is not lowered in a state illustrated in FIG. 3B in which the frame 212 of the maintenance device 81 is returned to the original position with respect to the sliding direction, i.e., the position at which the cap member 82*a* opposes the recording head 34*a* for black ink.

Such a configuration can also prevent conflict of the cap member 82*a* with the recording heads 34*b*, 34*c*, and 34*d* (indicated by a star-like solid mark G2 in FIG. 3C) caused when the cap member 32*a* is not lowered in a state illustrated in FIG. 3C in which the frame 212 of the maintenance device 81 can oppose the recording heads 34*b*, 34*c*, and 34*d*. As described above, the controller permits or rejects movement of the carriage 33 having the recording heads 34 to the original position in response to detection results of an elevation position of the cap member 82*a* while referring to detection results of a sliding position of the frame 212 of the maintenance device 81.

According to the above-described procedure, the movement of the carriage 33 to return to the original position is performed as a precondition that the cap member 82*a* is lowered. Such a configuration prevents careless rotation of the cam shaft 213 when the home position of the cam shaft 213 cannot be detected, thus preventing conflict of the cap member 82*a* with the nozzle faces of the recording heads 34.

Figure 15A:
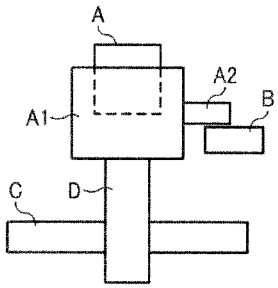
FIGS. 15A and 15B are schematic views of a cap position detection device in a comparative example of a maintenance device.
Figure 15B:
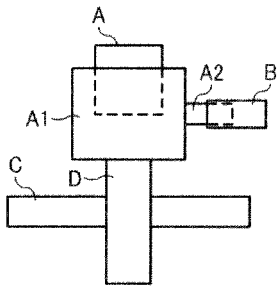
Figure 16:
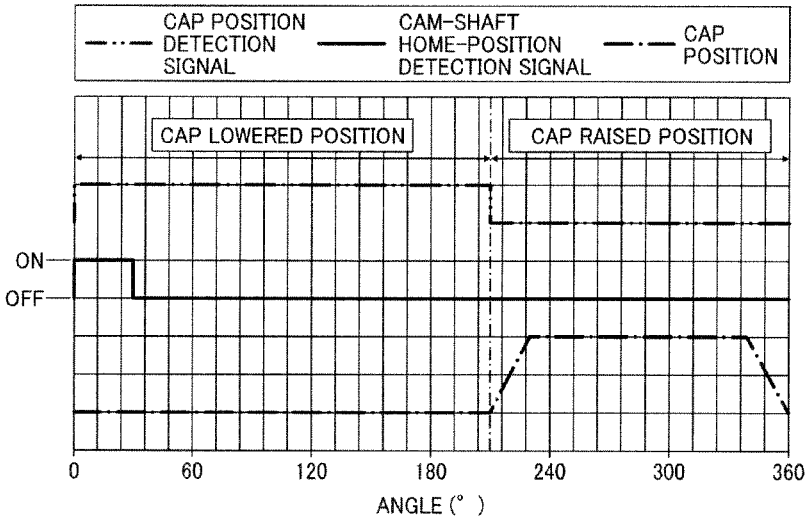
FIG. 16 is a timing chart of a relation of cam-shaft home-position detection timing, cap position detection timing, and a cam profile in the comparative example of the maintenance device of FIGS. 15A and 15B.

The image forming apparatus having the above-described configuration in this exemplary embodiment can detect both the home position of the cam shaft 213 and the position of the cap member 82 during one rotation of the cam shaft 213 by the feeler member 241' of the maintenance device 81. For the detection of an elevation position of the cap member, a configuration of a comparative example is illustrated in FIGS. 15A and 15B, and detection signals and a cam profile obtained from the configuration of the comparative example are shown in FIG. 16. Differences between the comparative example of FIGS. 15A, 15B, and 16 and this exemplary embodiment are described below.

In FIGS. 15A and 15B, a position detecting device of a cap member A includes a cap position detection feeler A2 mounted on a cap holder A1 holding the cap member A and a cap position sensor B, e.g., s a transmissive photosensor supported at a position differing from the cap holder A1. In FIGS. 15A and 15B, a cam shaft C is provided with a cap cam D to elevate the cap holder A1 up and down.

FIG. 15A shows a state in which the cap member A is raised. In such a state, the cap position sensor B is offset from the cap position detection feeler A2. FIG. 15B shows a state in which the cap member A is lowered from the state illustrated in FIG. 15A. In such a case, when the cap cam D contacting a bottom portion of the cap holder A1 is rotated to lower the cap member A, the cap position detection feeler A2 opposes the cap position sensor B. As a result, a shaded state of the cap position sensor B changes, thus allowing detection of a lowered state of the cap member A.

For the comparative example of FIGS. 15A and 15B, when a cam-shaft home-position detection device and a cap position detection device are used, a relation between detection signals and a cam profile is set as illustrated in FIG. 16. In FIG. 16, detection signals from the cam-shaft home-position detection device and the cap position detection device are adjusted with a cam profile corresponding to an elevation stroke of the cap cam D.

Such a configuration requires the cam-shaft home-position detection device and the cap position detection device separately, thus increasing the number of components and a setting space.

In addition, since detection of a home position of the cam shaft C is determined by a signal line output from a position differing from detection of an elevation position of the cap member A, for example, the cam shaft C might be rotated in a state in which the elevation position of the cap member A is not detected. In such a case, the cap member A might conflict a nozzle face of a recording head when a carriage returns to a scanning start position (original position) after a sheet jam is removed.

By contrast, in this exemplary embodiment, the circumferential length of the feeler member 241' has a portion (L1A in FIG. 10) corresponding to a detection period of the home position of the cam shaft 213 and a portion (L1B in FIG. 10) extended so as to correspond to a period for determining an elevation position of the cap member 82. Such a configuration can minimize the number of detecting members for multiple detection targets, thus allowing a simplified configuration.

Such a configuration also allows detection signals to be output from a single signal line instead of multiple signal lines. As a result, such a configuration prevents a failure in which detection signals cannot be obtained from one of multiple signal lines, thus preventing a cap member 82 from conflicting nozzle faces of recording heads 34 when the carriage 33 starts to move to the original position with the cap member 82 not lowered.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a plurality of recording heads having a plurality of nozzle rows to eject liquid droplets and a plurality of nozzle faces provided with the plurality of nozzle rows;

a maintenance device to maintain and recover an ejection performance of the plurality of recording heads;

a carriage mounting the plurality of recording heads and movable for scanning in a first direction, at least one of the plurality of nozzle rows of the plurality of recording heads offset from at least another of the plurality of nozzle rows in a second direction perpendicular to the first direction;

a plurality of cap members to cap the plurality of nozzle faces, at least one of the plurality of cap members being a suction cap reciprocally movable in the second direction to cap each of the plurality of nozzle faces to suck liquid from the plurality of nozzle rows;

a plurality of cams to raise and lower the plurality of cap members;

a cam shaft mounted with the plurality of cams to rotate the plurality of cams;

a feeler member of a semicircular shape mounted on the cam shaft to rotate with the cam shaft;

a home position detection device to detect the feeler member to detect a home position of the cam shaft; and a cap position determination device to determine whether the plurality of cap members is at a raised position or a lowered position, wherein the feeler member has a first portion to detect the home position of the cam shaft with the home position detection device and a second portion to determine with the cap position determination device whether the plurality of cap members is at the raised position or the lowered position, and when the cap position determination device determines that the suction cap is at the raised position, the suction cap is lowered to the lowered position before the carriage mounting the plurality of recording heads moves for scanning in the first direction, and when the cap position determination device determines that the suction cap is at the lowered position, the carriage is permitted to move to a print start position.

2. The image forming apparatus of claim 1, wherein the feeler member has a circumferential length corresponding to a period in which the suction cap is lowered with rotation of the cam shaft.

3. The image forming apparatus of claim 1, wherein the home position detection device also serves as the cap position determination device.

4. The image forming apparatus of claim 1, wherein each of the plurality of recording heads has multiple nozzle rows of the plurality of nozzle rows.

* * * * *